US007283028B2

(12) United States Patent
Yoshida et al.

(10) Patent No.: US 7,283,028 B2
(45) Date of Patent: Oct. 16, 2007

(54) COIL COMPONENT

(75) Inventors: Makoto Yoshida, Chuo-ku (JP); Tomokazu Ito, Chuo-ku (JP); Tadashige Konno, Chuo-ku (JP); Nobuyuki Okuzawa, Chuo-ku (JP)

(73) Assignee: TDK Corporation, Tokyo (JP)

( * ) Notice: Subject to any disclaimer, the term of this patent is extended or adjusted under 35 U.S.C. 154(b) by 111 days.

(21) Appl. No.: 10/909,421

(22) Filed: Aug. 3, 2004

(65) Prior Publication Data

US 2005/0030144 A1 Feb. 10, 2005

(30) Foreign Application Priority Data

Aug. 7, 2003 (JP) ..... 2003-289244
Aug. 7, 2003 (JP) ..... 2003-289276

(51) Int. Cl.
*H01F 5/00* (2006.01)

(52) U.S. Cl. ..... 336/200; 336/223; 336/232

(58) Field of Classification Search ..... 336/200, 336/223, 232

See application file for complete search history.

(56) References Cited

U.S. PATENT DOCUMENTS 4,992,769 A 2/1991 Oppelt
6,002,161 A * 12/1999 Yamazaki ..... 257/531
6,608,364 B2 * 8/2003 Carpentier ..... 257/531
6,759,937 B2 * 7/2004 Kyriazidou ..... 336/200
6,879,234 B2 * 4/2005 Furumiya et al. ..... 336/200
2003/0071706 A1 * 4/2003 Christensen ..... 336/200
2003/0137384 A1 * 7/2003 Itou et al. ..... 336/200
2003/0210122 A1 * 11/2003 Concord et al. ..... 336/200

FOREIGN PATENT DOCUMENTS

JP A 2002-110423 4/2002

* cited by examiner

*Primary Examiner*—Anh Mai
(74) *Attorney, Agent, or Firm*—Oliff & Berridge, PLC

(57) ABSTRACT

Each of first and second coil conductors has a spiral form and is disposed between first and second magnetic substrates. The first and second coil conductors include first parts arranged so as to extend along each other with a predetermined gap therebetween on a first insulating layer, and second parts intersecting each other three-dimensionally. The first and second coil conductors intersect each other in their middle part as seen from a direction orthogonal to the principal face of the first magnetic substrate (second magnetic substrate).

8 Claims, 7 Drawing Sheets

21
3

23
21
3

23
23
21
3

25
23
21
3

25
25
21
25
3

5a,7a
25
21
5a,7a
25
21
5a,7a
25
21
3

COIL COMPONENT

BACKGROUND OF THE INVENTION

1. Field of the Invention

The present invention relates to a coil component.

2. Related Background Art

Known as this kind of coil component is one (common mode choke coil) in which spirally formed first and second coil conductors are disposed on the same surface between magnetic substance layers. Arranging the first and second coil conductors on the same surface as such can enhance the magnetic coupling between the first and second coil conductors and attain a lower profile, thereby increasing their dielectric strength.

SUMMARY OF THE INVENTION

Since the first and second coil conductors are disposed so as to extend along each other with a predetermined gap therebetween, however, the first and second coil conductors may yield a large difference in their line lengths in the coil component configured as mentioned above. As a result, the first and second coil conductors may differ from each other in terms of impedance.

For overcoming the problem mentioned above, it is an object of the present invention to provide a coil component which can easily make the first and second coil conductors attain the same impedance, while having a simple configuration.

In one aspect, the present invention provides a coil component comprising spirally formed first and second coil conductors disposed between magnetic substance layers; wherein the first and second coil conductors include first parts arranged so as to extend along each other with a predetermined gap therebetween on the same surface, and second parts three-dimensionally intersecting each other.

Since the first and second coil conductors intersect each other three-dimensionally in the second parts, outer and inner positions of spirals of the first and second coil conductors are exchanged at the intersection in the coil component in accordance with this aspect of the present invention. Therefore, the difference in line length between the first and second coil conductors can be made smaller than that in the case where the first and second coil conductors do not intersect. When the intersection is appropriately set, the first and second coil conductors can exhibit the same line length. As a result, a very simple configuration in which the first and second coil conductors intersect in the second parts can easily make the first and second coil conductors attain the same impedance.

Preferably, the coil component further comprises an extraction electrode electrically connected to one end of the first and second coil conductors, while one of the second parts of the first and second coil conductors and the extraction electrode are formed on the same surface. In this case, one of the second parts of the first and second coil conductors and the extraction electrode can be formed in the same step. This can prevent the steps of making the coil component from increasing.

Preferably, pairs of the second parts of the first and second coil conductors are provided by an even number. When the first and second coil conductors intersect three-dimensionally in the second parts, the outer and inner positions of spirals of the first and second coil conductors are exchanged at the intersection as mentioned above. When pairs of the second parts of the first and second coil conductors are provided by an odd number, the positions of the first and second coil conductors are exchanged between one end side and the other end side. As a consequence, the arrangement of terminal electrodes connected to the first and second coil conductors differs from that in conventional coil components. When pairs of the second parts of the first and second coil conductors are provided by an even number, however, the arrangement of terminal electrodes on one end side of the first and second coil conductors does not differ from that on the other end side.

In another aspect, the present invention provides a coil component comprising spirally formed first and second coil conductors disposed between magnetic substance layers; wherein the first and second coil conductors intersect each other in a middle part thereof as seen from a direction orthogonal to a surface of the magnetic substance layers.

Since the first and second coil conductors intersect each other in a middle part thereof as seen from a direction orthogonal to the magnetic substance layer surface, outer and inner positions of spirals of the first and second coil conductors are exchanged at the intersection in the middle part in the coil component in accordance with this aspect of the present invention. Therefore, the difference in line length between the first and second coil conductors can be made smaller than that in the case where the first and second coil conductors do not intersect. When the intersection is appropriately set, the first and second coil conductors can exhibit the same line length. As a result, a very simple configuration in which the first and second coil conductors intersect in the middle part can easily make the first and second coil conductors attain the same impedance.

Preferably, the first and second coil conductors intersect each other by an even number of times. When the first and second coil conductors intersect each other, the outer and inner positions of spirals of the first and second coil conductors are exchanged at the intersection in the middle part as mentioned above. When the first and second coil conductors intersect by an odd number of times, the positions of the first and second coil conductors are exchanged between one end side and the other end side. As a consequence, the arrangement of terminal electrodes connected to the first and second coil conductors differs from that in conventional coil components. When the first and second coil conductors intersect each other by an even number of times, however, the arrangement of terminal electrodes on one end side of the first and second coil conductors does not differ from that on the other end side.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

In the following, with reference to the accompanying drawings, preferred embodiments of the present invention will be explained in detail. In the explanation, constituents identical to each other or those having functions identical to each other will be referred to with numerals identical to each other without repeating their overlapping descriptions. This embodiment shows an example in which the present invention is employed in a common mode choke coil (common mode choke coil array).

Figure 1:
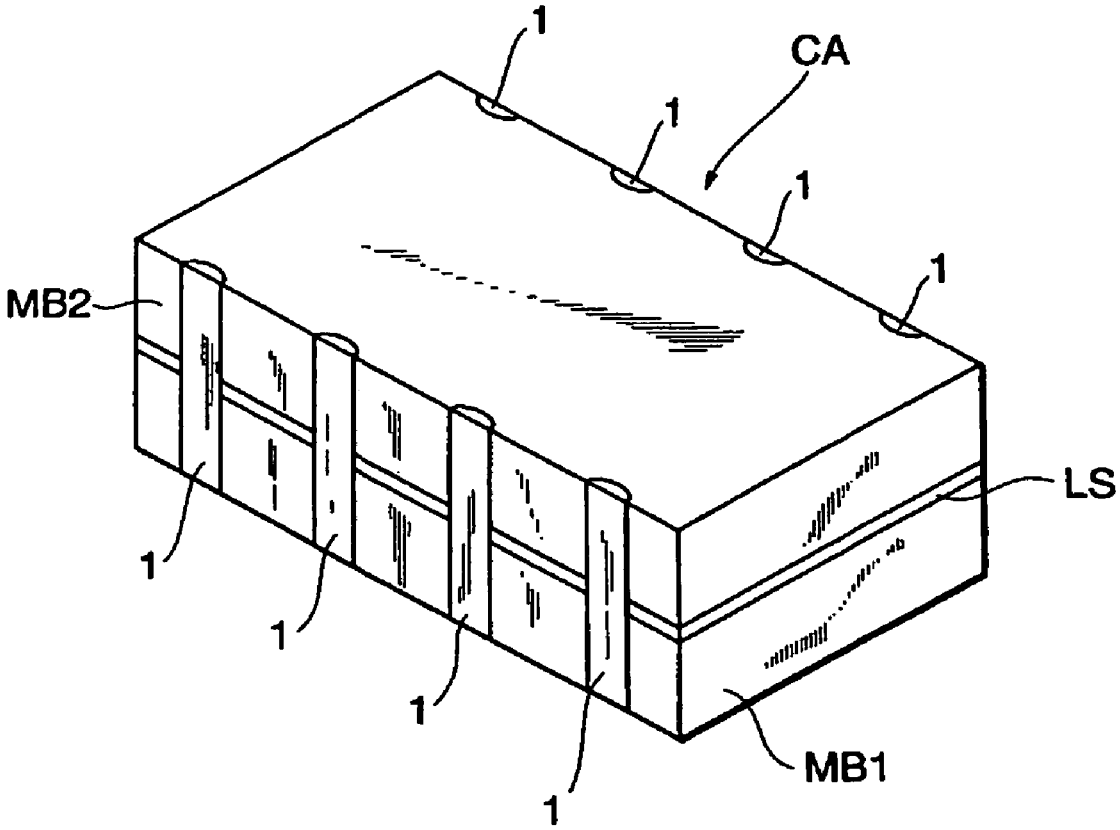
FIG. 1 is a perspective view showing a common mode choke coil array in accordance with an embodiment.
Figure 2:
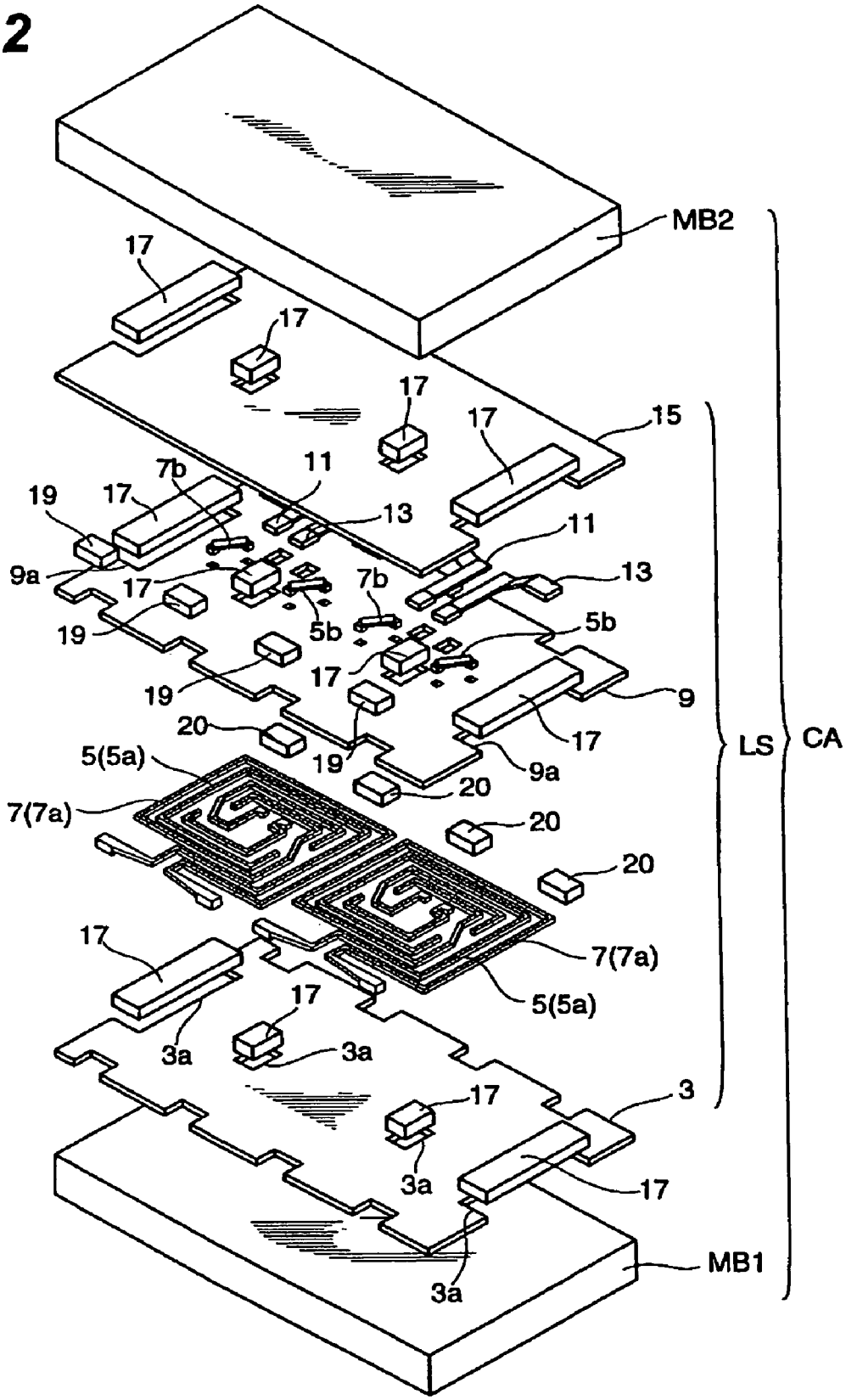
FIG. 2 is an exploded view showing the common mode choke coil array in accordance with the embodiment.
Figure 3:
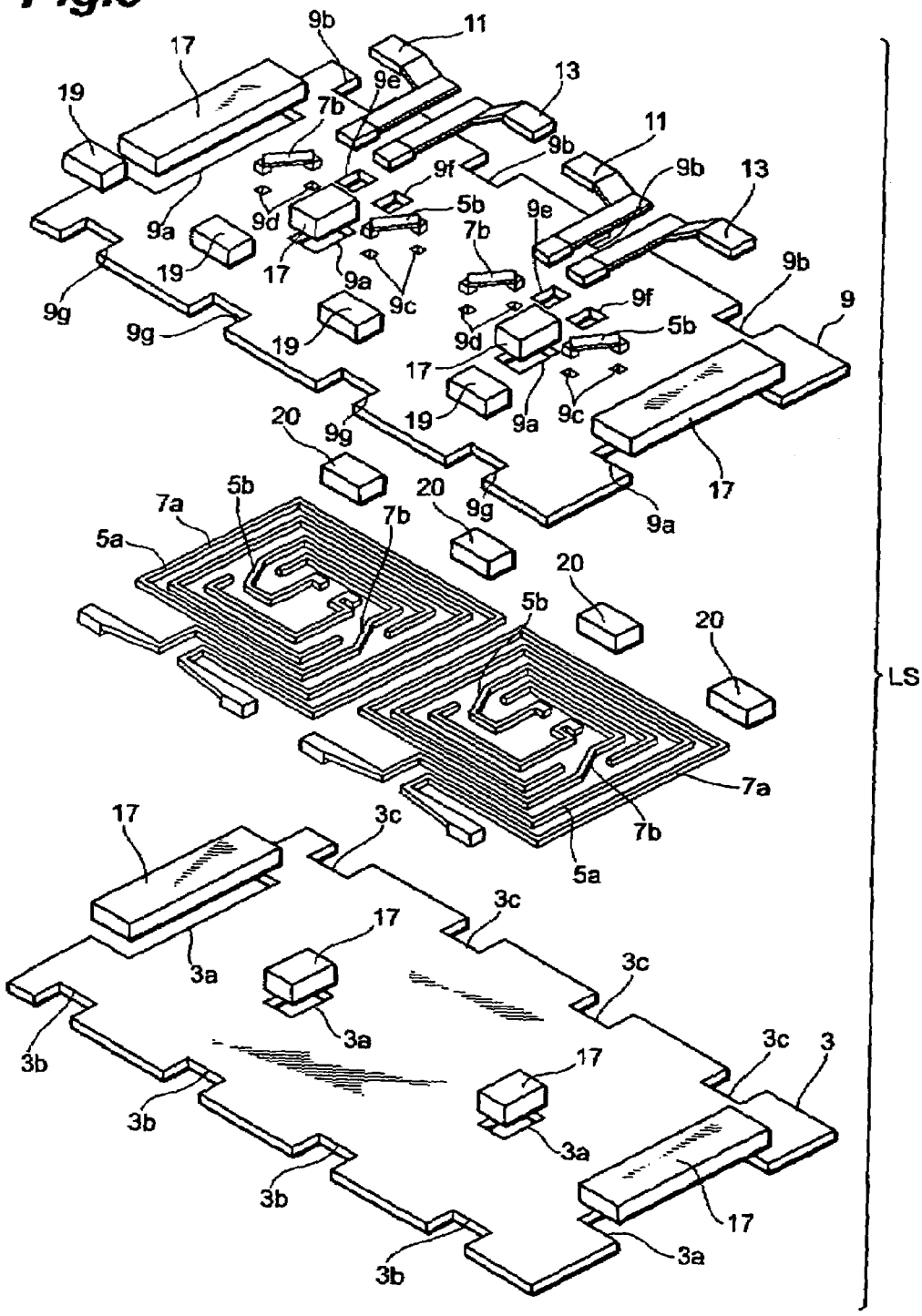
FIG. 3 is an exploded view showing a part of the common mode choke coil array in accordance with the embodiment.
Figure 4A:
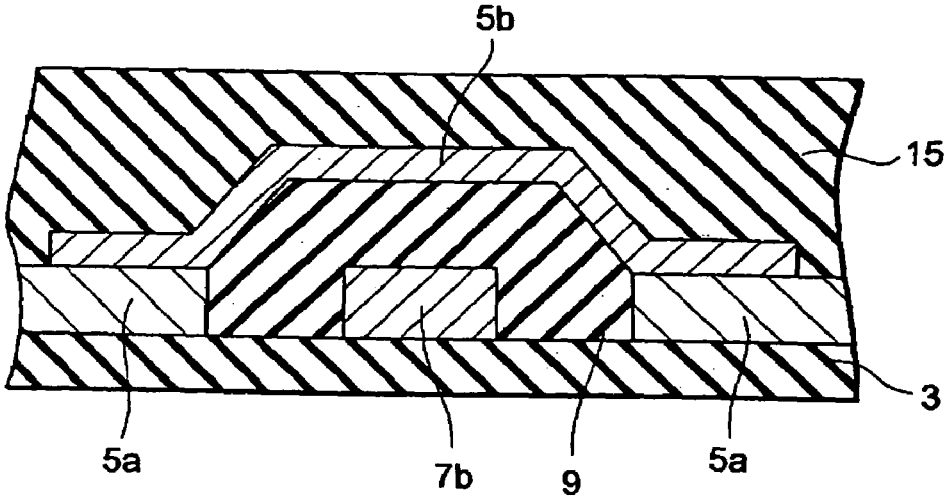
FIG. 4A is a view for explaining a cross-sectional configuration at a position where first and second coil conductors intersect each other three-dimensionally.
Figure 4B:
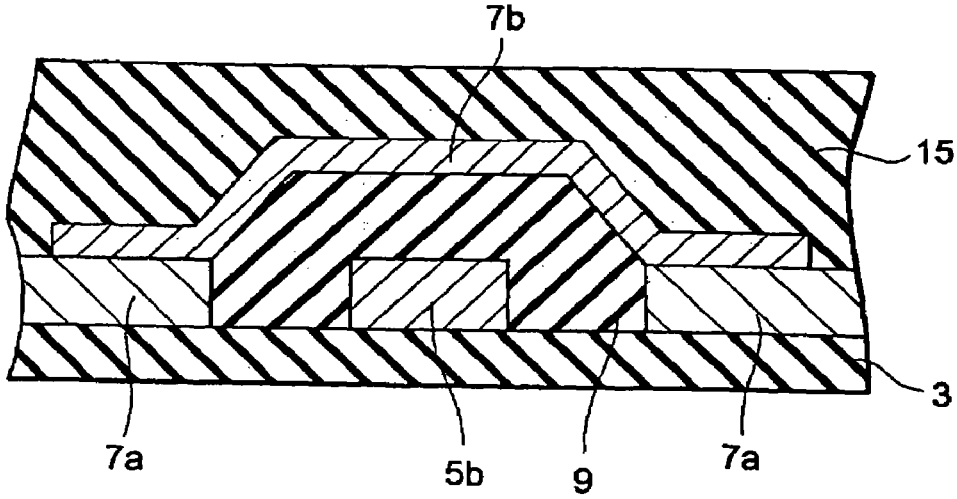
FIG. 4B is a view for explaining a cross-sectional configuration at a position where the first and second coil conductors intersect each other three-dimensionally.

FIG. 1 is a perspective view showing the common mode choke coil array in accordance with this embodiment. FIGS. 2 and 3 are exploded views showing the common mode choke coil array in accordance with this embodiment. FIGS. 4A and 4B are views for explaining cross-sectional configurations at positions where first and second coil conductors intersect each other three-dimensionally.

As shown in FIG. 1, the common mode choke coil array CA is a thin-film type common mode choke coil array comprising a first magnetic substrate MB1 (magnetic substance layer), a layer structure LS, and a second magnetic substrate MB2 (magnetic substance layer). Terminal electrodes 1 are formed on outer peripheral faces of the laminate constituted by the first magnetic substrate MB1, layer structure LS, and second magnetic substrate MB2.

As shown in FIG. 2, the layer structure LS is formed by a plurality of layers laminated by a thin film forming technique, and includes a first insulating layer 3, first coil conductors 5, second coil conductors 7, a second insulating layer 9, first extraction electrodes 11, second extraction electrodes 13, and a third insulating layer 15. The common mode choke coil array CA is configured such that a plurality of sets (two sets in this embodiment) of the first coil conductors 5 and second coil conductors 7 are arranged in parallel.

The first magnetic substrate MB1 is made of a magnetic material such as sintered ferrite or composite ferrite (resin containing powdery ferrite).

The first insulating layer 3 is made of a resin which is excellent in electric and magnetic insulation while exhibiting a favorable processability, such as polyimide and epoxy resins. The first insulating layer 3 is used for alleviating irregularities of the first magnetic substrate MB1 and improving its adhesion to conductors such as the first coil conductors 5 and second coil conductors 7. The thickness of the first insulating layer 3 can be set to 0.1 to 10 μm, for example.

The first insulating layer 3 is formed with openings (which may also be cutouts) 3*a* and cutouts 3*b* as shown in FIG. 3 as well. Arranged in the openings 3*a* are respective magnetic bodies 17 for forming closed magnetic paths between the first magnetic substrate MB1 and the second magnetic substrate MB2. End parts of the first coil conductors 5 and second coil conductors 7 are exposed at the cutouts 3*b*. The openings 3*a* are formed in center areas and outer peripheral areas of the first coil conductors 5 and second coil conductors 7. The magnetic bodies 17 are made of a magnetic material such as composite ferrite.

In the following manner, the first insulating layer 3 is formed. First, the resin material is applied onto the first magnetic substrate MB1. For applying the resin material, spin coating, spraying, and the like can be used. Thus applied resin material is exposed to light, developed, and then cured in a state where the openings 3*a*, cutouts. 3*b*, and the like are formed at predetermined positions.

The first coil conductors 5 and second coil conductors 7 have spiral forms and contain a conductive metal material. (e.g., Cu). As shown in FIGS. 4A and 4B, the first coil conductors 5 and second coil conductors 7 include first parts 5*a*, 7*a* and second parts 5*b*, 7*b*. The first parts 5*a*, 7*a* are arranged so as to extend along each other with a predetermined gap (e.g., about 50 μm) therebetween on the first insulating layer 3. The second parts 5*b*, 7*b* intersect each other three-dimensionally. Pairs of the second parts 5*b*, 7*b* of the first coil conductors 5 and second coil conductors 7 are provided by an even number (2 in this embodiment). The first parts 5*a* of the first coil conductors 5 are broken in the middle so that the second parts 7*b* of the second coil conductors 7 cut across them. The first parts 7*a* of the second coil conductors 7 are broken in the middle so that the second parts 5*b* of the first coil conductors 5 cut across them. Each of the first coil conductors 5 and second coil conductors 7 can have a thickness set to 3 to 20 μm, for example. Each of the first coil conductors 5 and second coil conductors 7 can have a width set to 5 to 30 μm, for example.

A portion of the first parts 5*a* and second parts 5*b* of the first coil conductors 5 and a portion of the first parts 7*a* and second parts 7*b* of the second coil conductors 7 are formed as shown in FIGS. 5A to 5F.

FIGS. 5A to 5F are views for explaining a portion of the first and second parts of the first and second coil conductors included in the common mode choke coil array in accordance with this embodiment.

Figures 5A, 5B, 5C, 5D, 5E, 5F:
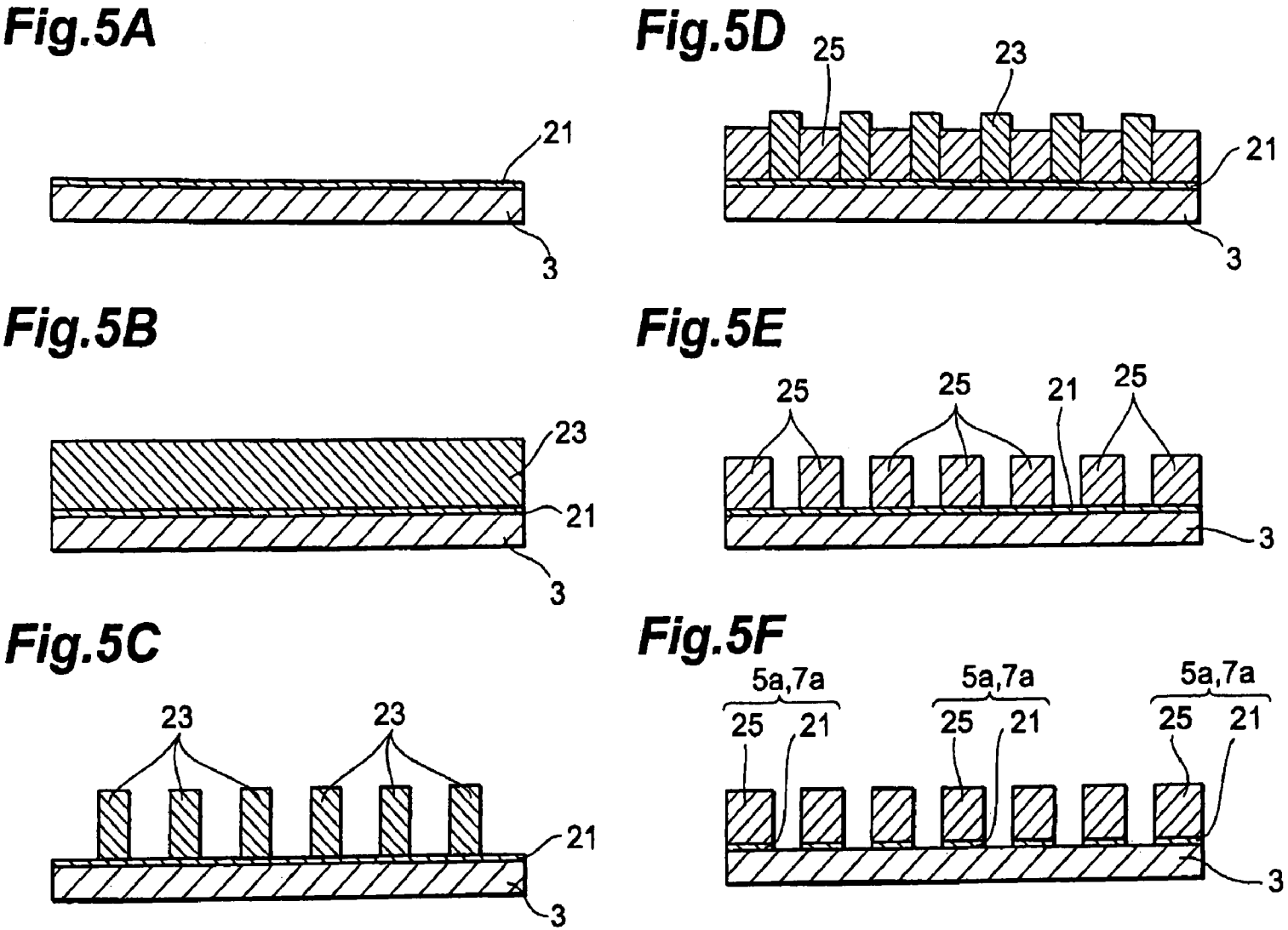
FIG. 5A to 5F are views for explaining an example of a method of making a portion of first and second parts of the first and second coil conductors included in the common mode choke coil array in accordance with the embodiment.

First, as shown in FIG. 5A, a base conductor film 21 is formed on the first insulating layer 3 by a vacuum film forming method (sputtering or the like). Here, in view of the adhesion to the first insulating layer 3 and the plating property, it will be preferred if the base conductor film 21 has a multilayer structure of Cr/Cu (in which Cr is on the first insulating layer 3 side) or Ti/Cu (in which Ti is on the first insulating layer 3 side).

Subsequently, as shown in FIG. 5B, a resist 23 is applied onto the base conductor film 21. Here, it will be preferred if the resist 23 is applied thicker than a conductive metal material 25 formed by electroplating.

Then, as shown in FIG. 5C, the resist 23 is exposed to light and developed, so as to form a mold corresponding to a spiral conductor pattern in which the first parts 5*a*, 7*a* extend along each other with a predetermined gap therebetween. Namely, the base conductor film 21 is exposed in conformity to the spiral conductor pattern. Exposure and development are carried out by a photolithography technique using a photomask having an opening corresponding to the spiral conductor pattern.

Next, as shown in FIG. 5D, the conductive metal material 25 is grown within the mold by electroplating while using the base conductor film 21 as an electrode, so as to form the spiral conductor pattern. In view of the plating property, cost, and conductivity, Cu is preferred as the conductive metal material 25. Here, if the electroplating condition is set such that the growth rate of the conductive metal material 25 changes depending on the pattern width, a conductor pattern whose thickness partly varies can be produced as shown in FIG. 3.

Subsequently, as shown in FIG. 5E., the resist 23 is eliminated. As a consequence, the conductive metal material 25 shaped into the spiral conductor pattern remains on the base conductor film 21.

Then, as shown in FIG. 5F, the exposed part of the base conductor film 21 is eliminated by etching or the like while using the conductive metal material 25 as a mask. This forms a portion of the first parts 5*a* and second parts 5*b* of the first coil conductors 5 and a portion of the first parts 7*a* and second parts 7*b* of the second coil conductors 7 which are arranged so as to extend along each other with a predetermined gap therebetween on the first insulating layer 3. In view of resistance to corrosion, adhesion to the second insulating layer 9, etc., Ni plating may be effected on the conductive metal material 25.

As with the first insulating layer 3, the second insulating layer 9 is made of a resin which is excellent in electric and magnetic insulation while exhibiting a favorable processability, such as polyimide and epoxy resins. The second insulating layer 9 can have a thickness set to 1 to 20 μm, for example.

The second insulating layer 9 is formed with openings (which may also be cutouts) 9*a* for arranging the magnetic bodies 17, and cutouts 9*b* for exposing end parts of the first extraction electrodes 11 and second extraction electrodes 13. The openings 9*a* correspond to openings 3*a*, and are formed at center areas and outer peripheral areas of the first coil conductors 5 and second coil conductors 7.

As is also shown in FIG. 4A, the second parts 5*b* of the first coil conductors 5 are formed on the second insulating layer 9 so as to correspond to positions where the first parts 5*a* of the first coil conductors 5 are broken (the second parts 7*b* of the second coil conductors 7 cut across the first parts 5*a* of the first coil conductors 5). Consequently, the second parts 5*b* of the first coil conductors 5 formed on the second insulating layer 9 and the second parts 7*b* of the second coil conductors 7 formed on the first insulating layer 3 intersect each other three-dimensionally. The second parts 5*b* of the first coil conductor 5 have one ends electrically connected to one broken ends of the first parts 5*a* of the first coil conductors 5, and the other ends electrically connected to the other broken ends of the first parts 5*a* of the first coil conductors 5.

As is also shown in FIG. 4B, the second parts 7*b* of the second coil conductors 7 are formed on the second insulating layer 9 so as to correspond to positions where the first parts 7*a* of the second coil conductors 7 are broken (the second parts 5*b* of the first coil conductors 5 cut across the first parts 7*a* of the second coil conductors 7). Consequently, the second parts 7*b* of the second coil conductors 7 formed on the second insulating layer 9 and the second parts 5*b* of the first coil conductors 5 formed on the first insulating layer 3 intersect each other three-dimensionally. The second parts 7*b* of the second coil conductor 7 have one ends electrically connected to one broken ends of the first parts 7*a* of the second coil conductors 7, and the other ends electrically connected to the other broken ends of the first parts 7*a* of the second coil conductors 7.

Figure 6:
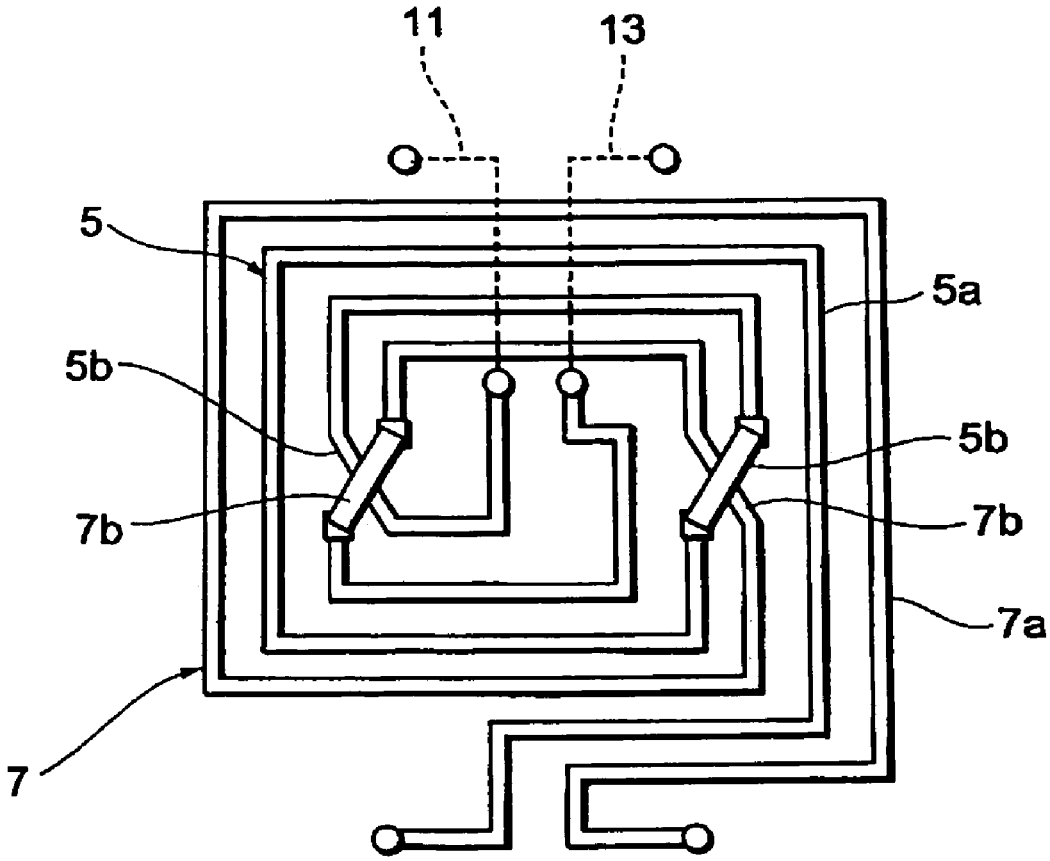
FIG. 6 is a schematic view for explaining forms of the first and second coil conductors included in the common mode field choke coil array in accordance with the embodiment.

Since the second part 5*b* of each first coil conductor 5 three-dimensionally intersects the second part 7*b* of its corresponding second coil conductor 7 at two locations, the first coil conductor 5 and second coil conductor 7 intersect each other two times in their middle part as seen from a direction orthogonal to the principal face of the first magnetic substrate MB1 (second magnetic substrate MB2) as shown in FIG. 6. FIG. 6 is a schematic view for explaining forms of the first and: second coil conductors included in the common mode choke coil array in accordance with this embodiment.

The second insulating layer 9 is formed with openings (contact holes) 9*c* for bringing the second parts 5*b* of the first coil conductors 5 formed on the second insulating layer 9 into contact with the first parts 5*a* of the first coil conductors 5 and electrically connecting them to each other. The second insulating layer 9 is also formed with openings (contact holes) 9*d* for bringing the second parts 7*b* of the second coil conductors 7 formed on the second insulating layer 9 into contact with the first parts 7*a* of the second coil conductors 7 and electrically connecting them to each other.

The first extraction electrodes 11 and second extraction electrodes 13 are formed on the, second insulating layer 9. One end of each electrode is electrically connected to the inner end part of its corresponding spiral of the first coil conductors 5 and second coil conductors 7, whereas the other end is exposed. Each of the first extraction electrodes 11 and second extraction electrodes 13 can have a thickness set to 1 to 10 μm, for example. Each of the first extraction electrodes 11 and second extraction electrodes 13 can have a width set to 1 to 25 μm, for example.

The second insulating layer 9 is formed with openings (contact holes) 9*e* for bringing the first extraction electrodes 11 formed on the second insulating layer 9 into contact with the first parts 5*a* of the first coil conductors 5 and electrically connecting them to each other. The second insulating layer 9 is also formed with openings (contact holes) 9*f* for bringing the extraction electrodes 13 formed on the second insulating layer 9 into contact with the first parts 7*a* of the second coil conductors 7 and electrically connecting them to each other.

The second insulating layer 9 is formed with cutouts 9*g* in conformity to the cutouts 3*b* formed in the first insulating layer 3. Disposed at the cutouts 9*g* are electrodes 19 coming into contact with end parts of the first coil conductors 5 and second coil conductors 7 so as to be electrically connected thereto. The first insulating layer 3 is formed with cutouts 3*c* in conformity to the cutouts 9*b* formed in the second insulating layer 9. Disposed at the cutouts 3*c* are electrodes 20 coming into contact with end parts of the first extraction electrodes 11 and second extraction electrodes 13 so as to be electrically connected thereto.

As with the first insulating layer 3, the second insulating layer 9 is formed on the first insulating layer 3, the first parts 5*a* of the first coil conductors 5, and the first parts 7*a* of the second coil conductors 7. When the first parts 5*a* of the first coil conductors 5 and the first parts 7*a* of the second coil conductors 7, are plated with Ni, it will be preferred if the portion of Ni plating exposed at the openings 9*c* to 9*f* is eliminated by etching or the like.

The second parts 5*b* of the first coil conductors 5, the second parts 7*b* of the second coil conductors 7, the first extraction electrodes 11, and the second extraction electrodes 13 are formed on the second insulating layer 9 as with the first parts 5*a* of the first coil conductors 5 and the first parts 7*a* of the second coil conductors 7.

As with the first insulating layer 3 and second insulating layer 9, the third insulating layer 15 is made of a resin which is excellent in electric and magnetic insulation while exhibiting a favorable processability, such as polyimide and epoxy resins. The third insulating layer 15 can have a thickness set to 0.1 to 10 μm, for example. The third insulating layer 15 is formed with openings (which may also be cutouts) 15*a* for disposing the magnetic bodies 17.

The third insulating layer 15 is formed on the second insulating layer 9, the second parts 5*b* of the first coil conductors 5, the second parts 7*b* of the second coil conductors 7, the first extraction electrodes 11, and the second extraction electrodes 13 as with the first insulating layer 3 and the second insulating layer 9.

When the third insulating layer 15 is formed, pasty composite ferrite produced by mixing ferrite powder with a resin material such as epoxy resin is applied onto the third insulating layer 15 and then cured. Here, the recesses constituted by the openings 15*a*, 9*a*, 3*a* are filled with the pasty composite ferrite. As a consequence, the magnetic bodies 17 are disposed at the openings 15*a*, 9*a*, 3*a*. In FIGS. 2 and 3, the magnetic bodies 17 are illustrated in a divided fashion in conformity to the insulating layers 3, 9, 15. The surface of the composite ferrite applied and cured on the third insulating layer 15 is polished, so as to be smoothed.

As with the first magnetic substrate MB1, the second magnetic substrate MB2 is made of a magnetic material such as sintered ferrite or composite ferrite. By way of an adhesive layer (not depicted), the second magnetic substrate MB2 is attached onto the composite ferrite whose surface was polished. The adhesive layer can be constituted by an adhesive such as epoxy resin, polyimide resin, or polyamide resin, for example. The thickness of the adhesive layer can be set to 1 to 5 μm, for example. The second magnetic substrate MB2 may be substituted by the cured composite ferrite made thicker.

The first coil conductors 5, the second coil conductors 7, the first extraction electrodes 11, and the second extraction electrodes 13 are in contact with their corresponding terminal electrodes 1 and electrically connected thereto.

In the common mode choke coil array CA constructed as mentioned above, the first coil conductors 5 and the second coil conductors 7 are magnetically coupled to each other. When a differential-mode current (anti-phase current) flows through the first coil conductors 5 and second coil conductors 7, magnetic fluxes cancel each other out, thereby lowering impedance. When a common-mode current (in-phase current) flows through the first coil conductors 5 and second coil conductors 7, by contrast, magnetic fluxes are added together, whereby impedance increases.

As in the foregoing, the first coil conductors 5 and the second coil conductors 7 intersect each other three-dimensionally in the second parts 5*b* and 7*b*, whereby outer and inner positions of spirals of the first coil conductors 5 and second coil conductors 7 are exchanged in the intersecting parts (second parts 5*b* and 7*b*). Therefore, the difference in line length between the first coil conductors 5 and the second coil conductors 7 can be made smaller than that in the case where the first coil conductors 5 and the second coil conductors 7 do not intersect each other. When intersecting positions are appropriately set, the first and second coil conductors can attain the same line length. As a result, a very simple configuration in which the first coil conductors 5 and the second coil conductors 7 intersect each other three-dimensionally in the second parts 5*b* and 7*b* can easily make the first coil conductors 5 and second coil conductors 7 attain the same impedance. In this embodiment, each of the first coil conductors 5 and second coil conductors 7 has a line length set to 23 mm.

Figure 7:
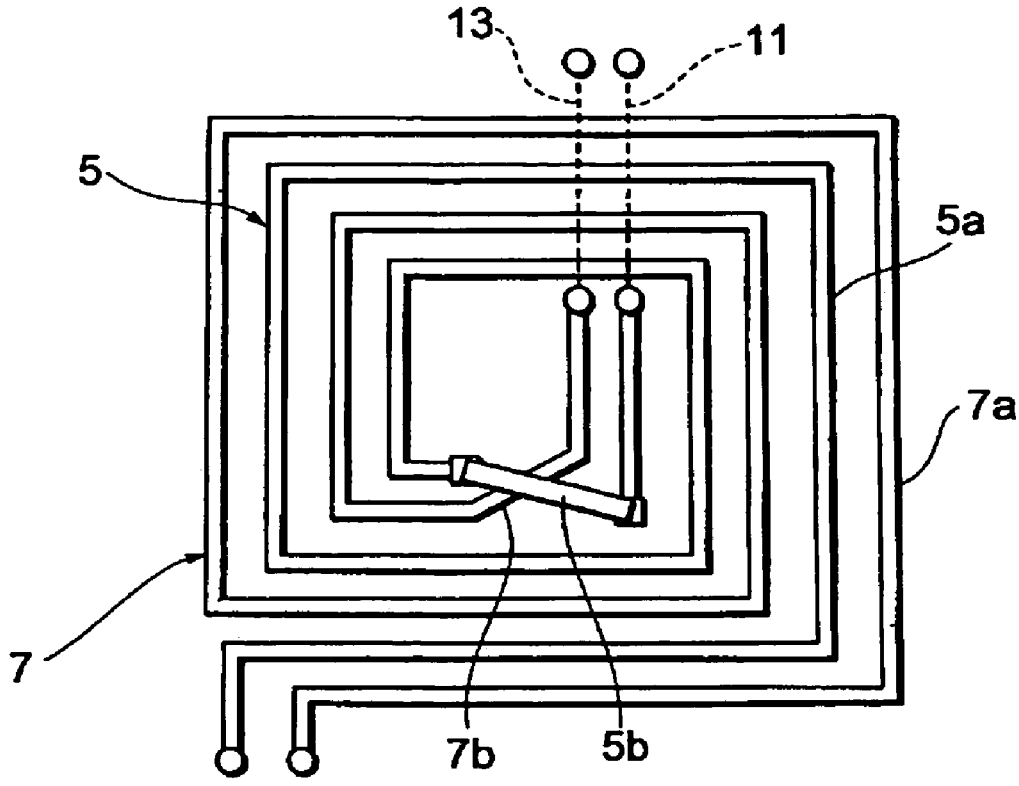
FIG. 7 is a schematic view for explaining an example of forms of the first and second coil conductors.

When the first coil conductors 5 and the second coil conductors 7 intersect each other three-dimensionally in the second parts 5*b*, 7*b*, the outer and inner positions of spirals of the first coil conductors 5 and second coil conductors 7 are exchanged in the intersecting parts as mentioned above. When pairs of the second parts 5*b*, 7*b* of the first coil conductor 5 and second coil conductor 7 are provided by an odd number (e.g., 1), positions of the first coil conductor 5 and second coil conductor 7 are exchanged between one end side and the other end side as shown in FIG. 7. This changes the arrangement of terminal electrodes connected to the first coil conductor 5 and second coil conductor 7. In this embodiment, by contrast, pairs of the second parts 5*b*, 7*b* of the first coil conductor 5 and second coil conductor 7 are provided by an even umber (2), so that the arrangement of the terminal electrodes 1 does not change between one end part side and the other end part side of the first coil conductor 5 and second coil conductor 7.

The common mode choke coil array CA in this embodiment includes the first extraction electrodes 11 and second extraction electrodes 13, whereas the second parts 5*b* of the first coil conductors 5, the second parts 7*b* of the second coil conductors 7, the first extraction electrodes 11, and the second extraction electrodes 13 are formed on the same surface (on the second insulating layer 9). Such a configuration makes it possible to form the second parts 5*b* of the first coil conductors 5, the second parts 7*b* of the second coil conductors 7, the first extraction electrodes 11, and the second extraction electrodes 13 in the same step. This can prevent the number of steps of making the common mode choke coil array CA from increasing.

Since the first parts 5*a* of the first coil conductors 5 and the first parts 7*a* of the second coil conductors 7 are formed on the same surface (on the first insulating layer 3), this embodiment can achieve a lower profile as compared with a common mode choke coil array configured such that the first coil conductors 5 and the second coil conductors 7 are laminated by way of an insulating layer. This shortens the magnetic path length, whereby an excellent impedance characteristic can be attained in high-frequency regions as well.

Since the first parts 5*a* of the first coil conductors 5 and the first parts 7*a* of the second coil conductors 7 are formed on the same surface (on the first insulating layer 3), the degree of magnetic coupling can be kept high in this embodiment.

The present invention is not restricted to the above-mentioned embodiment. For example, though the first coil conductor 5 and the second coil conductor 7 intersect each other three-dimensionally at two positions, they may intersect each other three-dimensionally at one position or three or more positions as well. The positions at which the first coil conductor 5 and the second coil conductor 7 intersect each other are not limited to those in the above-mentioned embodiment, either.

Though the second parts 5*b* of the first coil conductors 5 and the second parts 7*b* of the second coil conductors 7 are formed on the same surface (on the second insulating layer 9) in this embodiment, they may be formed on different surfaces as well.

Without being limited to the common mode choke coil array CA, the present invention is also applicable to coil components such as a common mode choke coil having one set of the first coil conductor 5 and second coil conductor 7, and transformers.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A coil component comprising spirally formed first and second coil conductors disposed between magnetic substance layers;

wherein the first and second coil conductors are magnetically coupled to each other and are electrically insulated from each other; and wherein the first and second coil conductors include first parts arranged so as to extend along each other with a predetermined gap therebetween on the same surface, and second parts three-dimensionally intersecting each other.

2. The coil component according to claim 1, further comprising an extraction electrode electrically connected to an end part of the first and second coil conductors; wherein one of the second parts of the first and second coil conductors and the extraction electrode are formed on the same surface.

3. The coil component according to claim 1, wherein pairs of the second parts of the first and second coil conductors are provided by an even number.

4. The coil component according to claim 1, wherein a plurality of the first and second coil conductors are arranged in parallel.

5. The coil component according to claim 1, wherein the first and second coil conductors have the same line length.

6. The coil component according to claim 1, wherein the first and second coil conductors have the same impedance.

7. The coil component according to claim 1, wherein the first and second coil conductors are formed using a photolithography technique and a plating technology.

8. The coil component according to claim 1, wherein each of the second parts has a sloping portion.

* * * * *